US006651395B2

(12) United States Patent
Capra

(10) Patent No.: US 6,651,395 B2
(45) Date of Patent: Nov. 25, 2003

(54) DEVICE FOR LIMITING THE RELATIVE MOVEMENT OF TWO ELEMENTS OF A CIVIL ENGINEERING STRUCTURE AND STRUCTURE INCLUDING SAID DEVICE

(75) Inventor: Alain Capra, Paris (FR)

(73) Assignee: Campenon Bernard SGE, Reuil Malmaison (FR)

( * ) Notice: Subject to any disclaimer, the term of this patent is extended or adjusted under 35 U.S.C. 154(b) by 0 days.

(21) Appl. No.: 09/779,897

(22) Filed: Feb. 8, 2001

(65) Prior Publication Data

US 2002/0011037 A1 Jan. 31, 2002

(30) Foreign Application Priority Data

Feb. 9, 2000 (FR) ..... 00 01597

(51) Int. Cl.[7] ..... E04H 9/02
(52) U.S. Cl. ..... 52/167.8; 52/167.3
(58) Field of Search ..... 52/167.3, 167.6, 52/167.8, 1, 223.13

(56) References Cited

U.S. PATENT DOCUMENTS 1,559,261 A * 10/1925 Konsalik
2,035,143 A * 3/1936 Cavaglieri
3,124,215 A * 3/1964 Fox ..... 188/377
3,871,147 A * 3/1975 Stegmeier ..... 249/20
3,963,099 A * 6/1976 Skinner et al. ..... 188/372
4,510,723 A * 4/1985 Soum ..... 52/223.13
4,805,359 A * 2/1989 Miyake
5,177,915 A * 1/1993 Kobori et al. ..... 248/548
5,226,583 A * 7/1993 Imashimizu et al. ..... 228/182
5,630,298 A * 5/1997 Tsai et al. ..... 52/167.3
5,833,038 A * 11/1998 Sheiba ..... 188/378
5,870,863 A * 2/1999 Taylor
5,934,028 A * 8/1999 Taylor
6,108,987 A * 8/2000 De La Fuente
6,192,637 B1 * 2/2001 Boilen
6,230,450 B1 * 5/2001 Kuroda
6,247,275 B1 * 6/2001 Taylor
6,343,449 B1 * 2/2002 MacKarvich

* cited by examiner

*Primary Examiner*—Carl D. Friedman
*Assistant Examiner*—Kevin McDermott
(74) *Attorney, Agent, or Firm*—Baker Botts L.L.P.

(57) ABSTRACT

Device (1) able to limit the amplitude of the relative movement of two elements of a civil engineering structure and for absorbing the deformation energy of this structure when the latter is subjected to an accidental stress. The device (1) includes: at least one portion able to undergo a plastic deformation at the time of the relative movement of the two elements of the structure, a guiding device for guiding the plastic deformation of the portion able to undergo a plastic deformation, the portion able to undergo a plastic deformation and the guiding device forming a single piece element.

22 Claims, 17 Drawing Sheets

DEVICE FOR LIMITING THE RELATIVE MOVEMENT OF TWO ELEMENTS OF A CIVIL ENGINEERING STRUCTURE AND STRUCTURE INCLUDING SAID DEVICE

FIELD OF THE INVENTION

The invention concerns a device for limiting the amplitude of the relative movement of two elements of a civil engineering structure or of a building and for absorbing the deformation energy of this structure when the latter is subjected to an accidental stress, such as an earthquake, an exceptional wind, an explosion, an impact, etc. The invention also relates to civil engineering structures or buildings comprising such a device.

BACKGROUND OF THE INVENTION TECHNOLOGY

There already exist devices based on the same principle as that of the invention, namely the plastic deformation of a bar guided via its support on a curved surface which guarantees a major length of the bar is plasticized whilst controlling the deformations. Devices of this type are described in the document FR 2 756 581 in the name of the applicant, and incorporated herein by reference for all purposes.

SUMMARY OF THE INVENTION

The device of the invention can be placed in the structure when the latter is in the course of being constructed or at a subsequent stage with the aim of strengthening the structure.

The object of the invention is to improve known devices so as to provide an extremely simple device to be embodied and able to mass produce.

Apart for its substantial reduction of the production costs, another objective of the invention is to provide a device easy to use including in existing structures.

To this effect, the device of the invention comprises: at least one portion able to undergo a plastic deformation at the time of the relative movement of the two elements of said structure, means for guiding the plastic deformation of the portion able to undergo a plastic deformation, the portion able to undergo a plastic deformation and the guiding means forming a single piece element.

Thus, the invention provides a device embodied in a single piece which resolves the problem of positioning the various portions of the device in relation to one another and simplifies the production method.

According to the invention, the portion able to undergo a plastic deformation includes at lease one bar, preferably with a rectangular section linked to the means for guiding the plastic deformation at the level of one of its extremities, and the means for guiding the plastic deformation include at least one curving template defining at lease one curved surface on which the portion, able to undergo a plastic deformation during said deformation folds.

The invention also concerns a device including several identical superimposed single piece elements.

The device may also include at least one support element fixed to at least one template and having one portion of its surface adjacent to at least one bar, said support element being intended to limit tilting of the device during deformation of said device.

According to a first embodiment, the device of the invention includes a plurality of bars placed approximately parallel to one another inside a given plane between two approximately parallel straight lines. The extremities of each of the bars which are aligned on one first straight line are linked to a first curing template and the extremities of each of the bars, which are aligned on the second straight line, are linked to a second curving template. The two templates are situated inside said plane approximately perpendicular to said bars and each defining a curved surface on both sides of each of the bars.

The invention also concerns a portico structure defining approximately elementary meshes and including at least this device. This structure comprises four bars placed in the form of a cross, each bar being fixed at one of its extremities at one angle of said mesh, two adjacent bars being fixed at the other of their extremities to a first template of said device, the other two bars being fixed at the other of their extremities to the second template of said device.

According to a second embodiment, the device of the invention includes four bars placed crosswise inside a given plane and approximately perpendicular to one another, four curving templates placed crosswise inside said plane approximately symmetrically, each of the templates being positioned between two bars, said templates each defining curved surfaces; so that one curved surface is placed on both sides of the bars.

The invention also concerns a portico structure defining approximately rectangular elementary meshes and including at lest this device. This structure comprises eight bars placed so that two bars are fixed by one of their extremities at each angle of said mesh, two bars fixed at two adjacent angles are linked via their other extremity to a given bar of said device.

According to a third embodiment, the device of the invention includes one bar linked at each of its extremities to a curving template, each of the templates defining two curved surfaces placed on both sides of the bar.

This device is intended to be placed inside a structure comprising lintels and to be fixed approximately horizontally on these lintels.

According to a fourth embodiment, the device includes inside a given plane two aligned bars and linked to each other via one of their extremities, two arms placed perpendicularly to the bars at the level of the common extremity of said bars so as to form a cross, two curving templates placed on both sides of the two bars at the level of the common extremity of said two bars, each template defining a curved surface for each of the two bars.

The invention also concerns a portico structure including approximately horizontal girders and approximately vertical poles and including at least this device positioned at the level of the intersection between the girders and poles, the bars of the device being fixed approximately horizontally on the girders and the arms being fixed approximately vertically on the poles.

According to a fifth embodiment, the extremity of the bar not linked to the guiding means has a rounded shape or is fitted with a joint, the device being intended to be placed inside a civil engineering structure including at least two portions between which seismic isolators are placed. According to this embodiment, the guiding means are secured to a first portion of said structure and the extremity of the bar not linked to the guiding means slides in a slide secured to a second portion of said structure.

Finally, the invention concerns a civil engineering structure including at least two portions and at least one device according to the second or third embodiment, said device being placed so that the central portion of the device situated towards the common extremity of the bars is linked to a support device fixed at one portion of said structure, the extremity of each of the arms and/or bars not linked to the guiding means being able to slide in a slide secured to another portion of said structure.

Other technical advantages of the present disclosure will be readily apparent to one skilled in the art from the following Figures, descriptions, and claims. Various embodiments of the invention obtain only a subset of the advantages set forth. No one advantage is critical to the invention.

BRIEF DESCRIPTION OF THE DRAWINGS

A more complete understanding of the present disclosure and advantages thereof may be acquired by referring to the following description taken in conjunction with the accompanying drawings, wherein.

Figure 1:
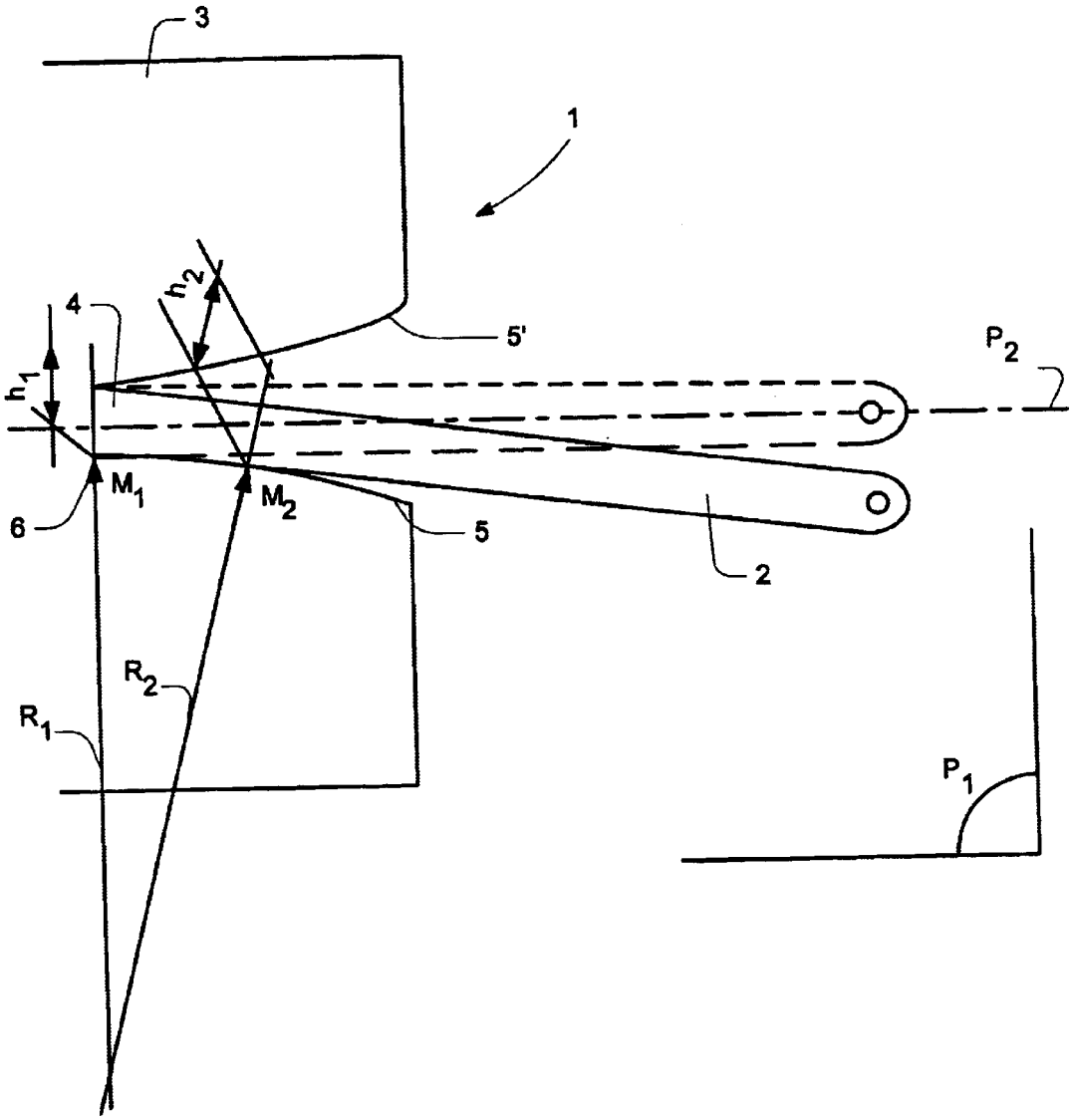
FIG. 1 is an elevation view of a device according to the invention.

While the present invention is susceptible to various modifications and alternative forms, specific exemplary embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

First of all, here follows a description of the general principal of the invention with reference to FIG. 1 which represents a device according to the invention. The device 1 includes a bar 2 and a curving template 3. The bar 2 is linked to the template 3 at the level of one of its extremities 4, the bar 2/template 3 unit forming a single piece element. This single piece element is preferably flat. Accordingly, the plane defined by this element shall be denoted by $P_1$, as shown on FIG. 1. The curving template 3 defines at least one curved surface 5 on which the bar 2 folds during its plastic deformation. FIG. 1 shows the position of the bar 2 at rest by the dotted line, as well as the position of this bar 2 during its deformation by the full lines. The curved surface 5 is tangent to the bar 2 at the level of the contact line 6 between the template 3 and the extremity 4 of the bar 2 linked to the template 3. The curved surface 5 diverges with respect to the bar 2 when seen from the contact line 6 and the convexity of the curved surface 5 is directed towards the bar 2.

According to a preferred embodiment of the invention, at any point $M_i$ of the curved surface 5 defined by the curving template 3, the radius of curvature $R_i$ of said curved surface 5 is proportional to the width $h_i$ of the bar 2 measured at the level of one point of said bar 2 intended to come into contact with said point $M_i$ of the curved surface 5 during plastic deformation. Thus, for points $M_1$ and $M_2$ of the curved surface 5 correspondingly respectively to radii of curvature $R_1$ and $R_2$ of the curved surface 5 and respectively to widths $h_1$ and $h_2$ of the bar 2, there is the following:

$$R_1/h_1=R_2/h_2 \text{ (see FIG. 1)}$$

This configuration, at any cross section of the bar 2, makes it possible to limit the relative variations of the length of the extreme fibers of the bar 2 to a value lower than the breaking point of the metal. In the case of a bar 2 whose width varies along the length, the template 3 shall have a variable radius of curvature along the point $M_1$ of the surface 5 in question, this radius of curvature depending on the corresponding width of the bar 2. Generally speaking, the ratio $R_1/h_1$ may be a calibrated function depending on the use of the device.

In a preferred embodiment of the invention, the bar 2 has a rectangular cross section and a plane of symmetry $P_2$ perpendicular to the plane $P_1$ and placed along the length of the bar 2. The template 3 also preferably defines two curved surfaces 5, 5' placed on both sides of the bar 2 and symmetrical with respect to the plane $P_2$.

For service cases, that is for operating charges, in normal temperature and wind conditions, the bar 2 has been designed so that its deformations remain inside the elastic field, its movements being compatible with the functioning of the equipment and the second structure, especially the facades, pipes, etc.

Figure 2:
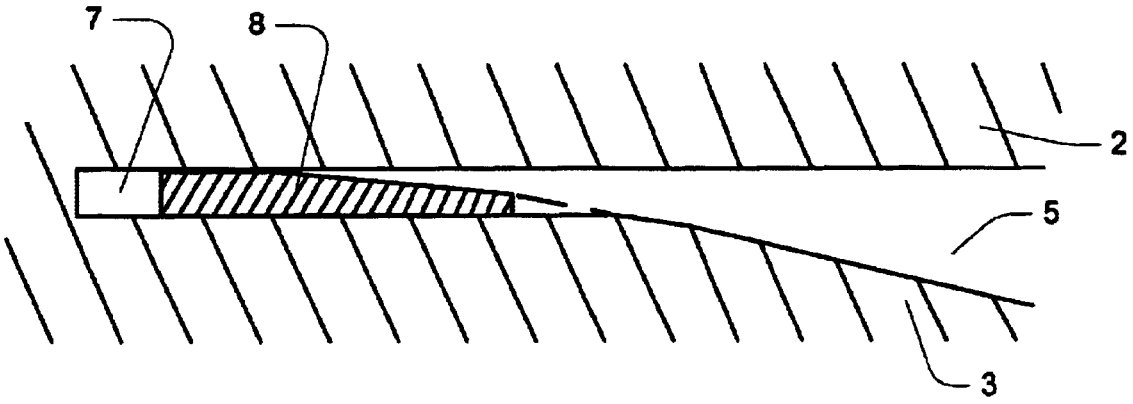
FIG. 2 is an enlarged view of one of the details of FIG. 1.

The device preferably is formed of steel, ductile cast iron, a metallic alloy or a composite with a metal die. The device is preferably embodied via the cutting of a metal plate using an oxyacetylene cutting torch, by a high pressure water jet, laser ray or any other system offering equivalent cutting precision. It can also be formed by molding. In certain cutting techniques, the width of the cutting groove 7 may prove to be excessive with regard to the general dimensions of the device to be embodied, as shown on FIG. 2. In the case of a cutting with a torch for example, the width of the groove may reach 4 mm. In this case the geometry of the template 3 is re-established by the adding of shims 8 machined and positioned in the groove 7.

There now follows a description of the various embodiments of the invention with reference to FIGS. 3 to 15.

Figure 3:
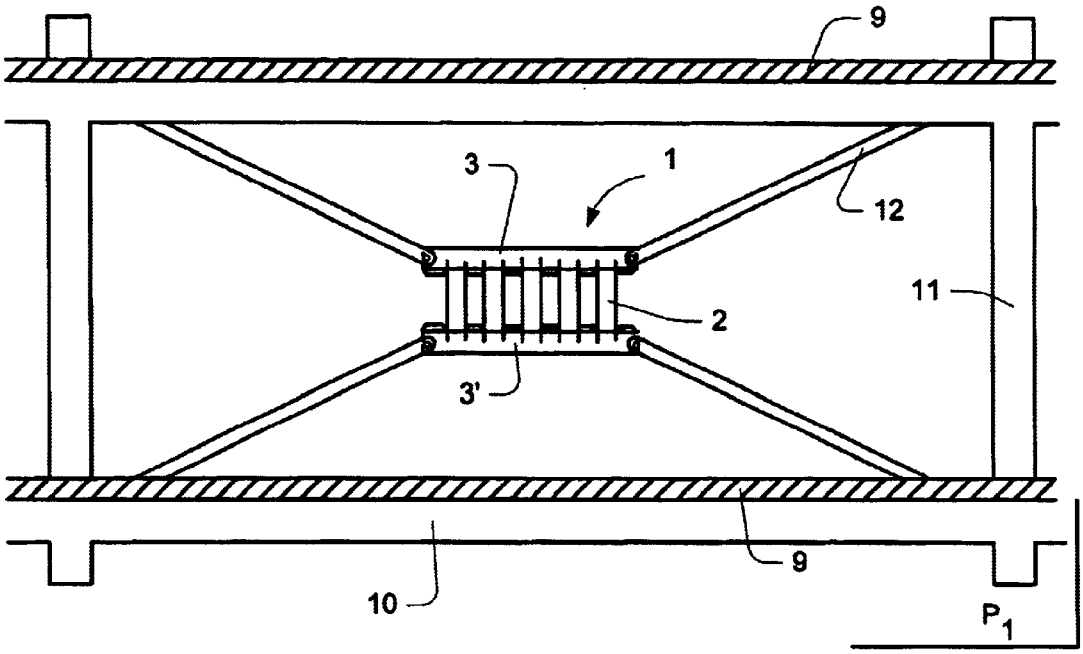
FIG. 3 is a cutaway view of a civil engineering structure comprising a device according to the invention according to a first embodiment.
Figure 4:
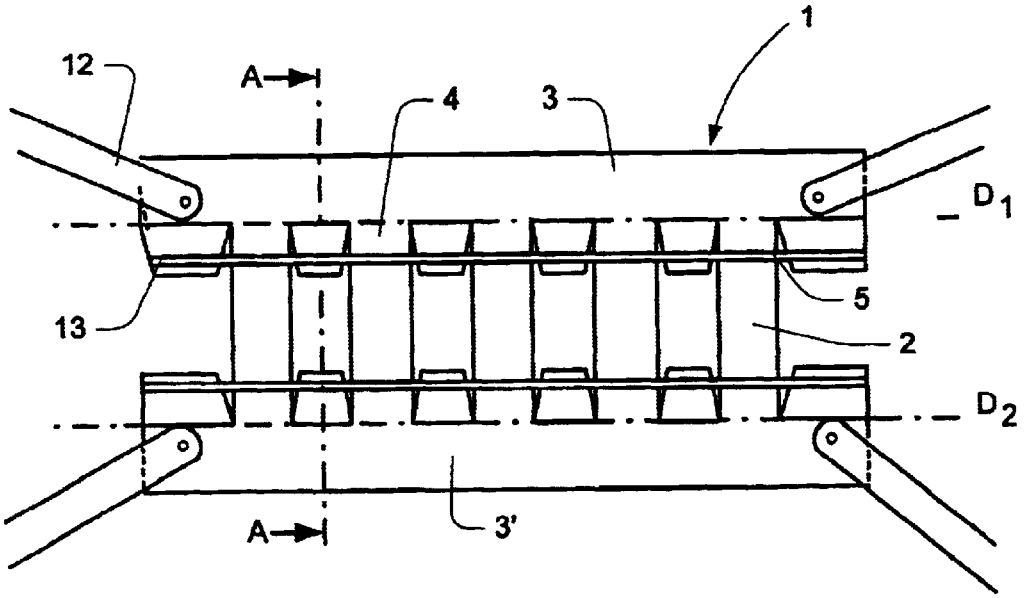
FIG. 4 is an enlarged view of FIG. 3.
Figure 5:
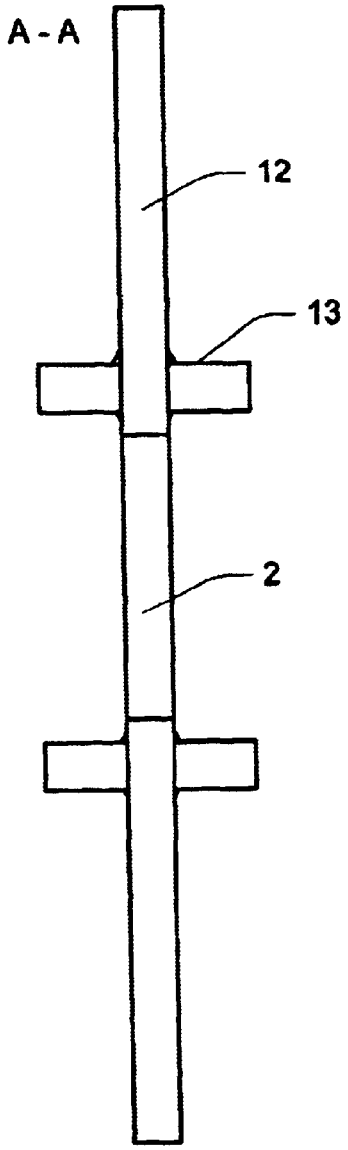
FIG. 5 is a view along the section A—A of the device of FIG. 4.
Figure 6:
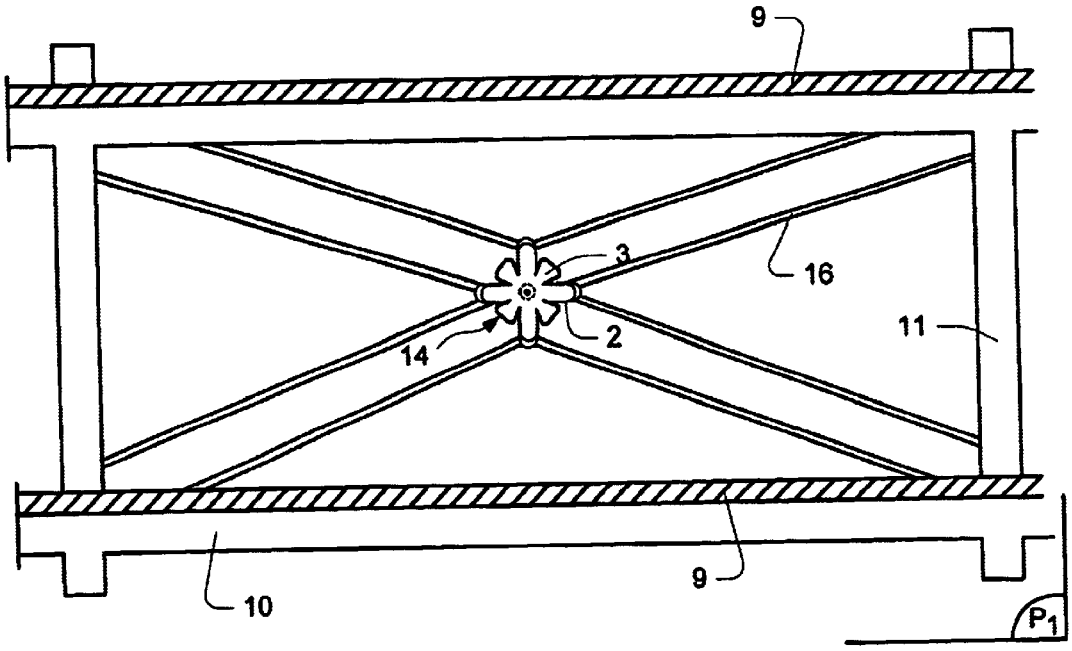
FIG. 6 is a cutaway view of a civil engineering structure comprising a device according to the invention according to a second embodiment.
Figure 7:
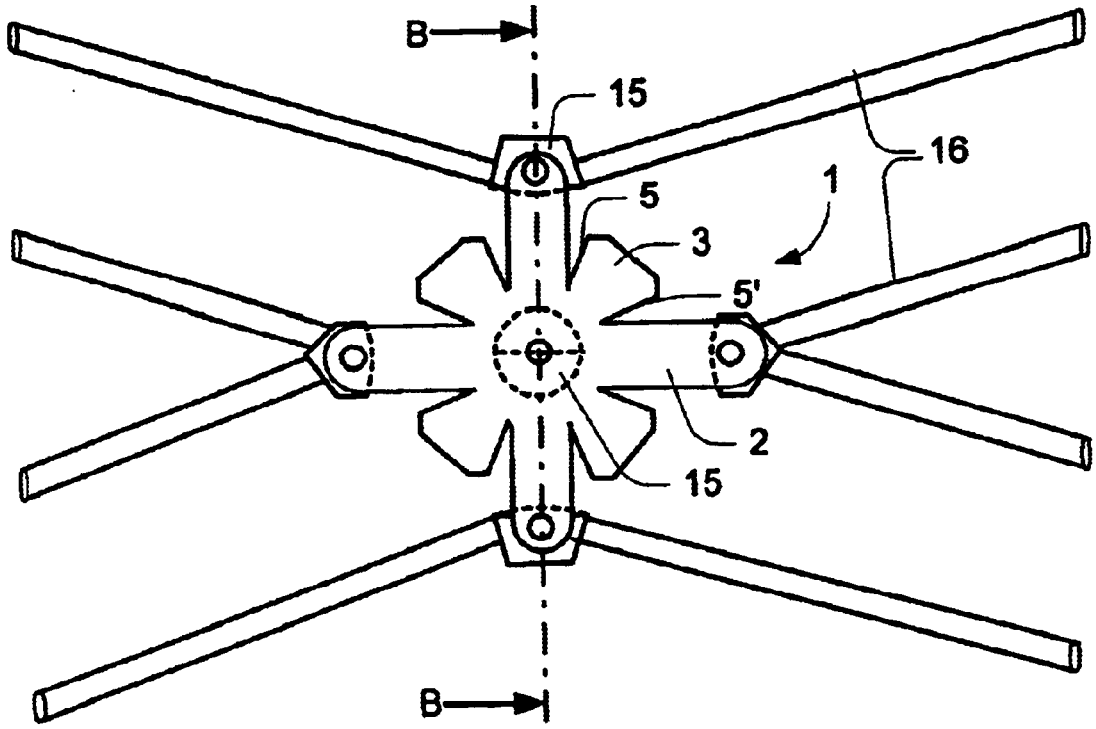
FIG. 7 is an enlarged view of FIG. 6.
Figure 8:
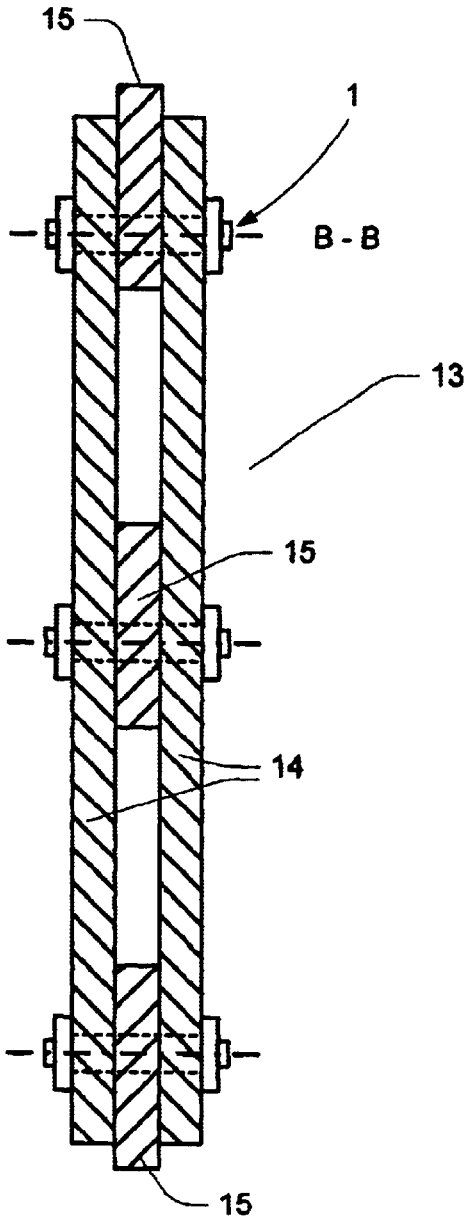
FIG. 8 is a view along the section B—B of the device of FIG. 7.
Figure 9:
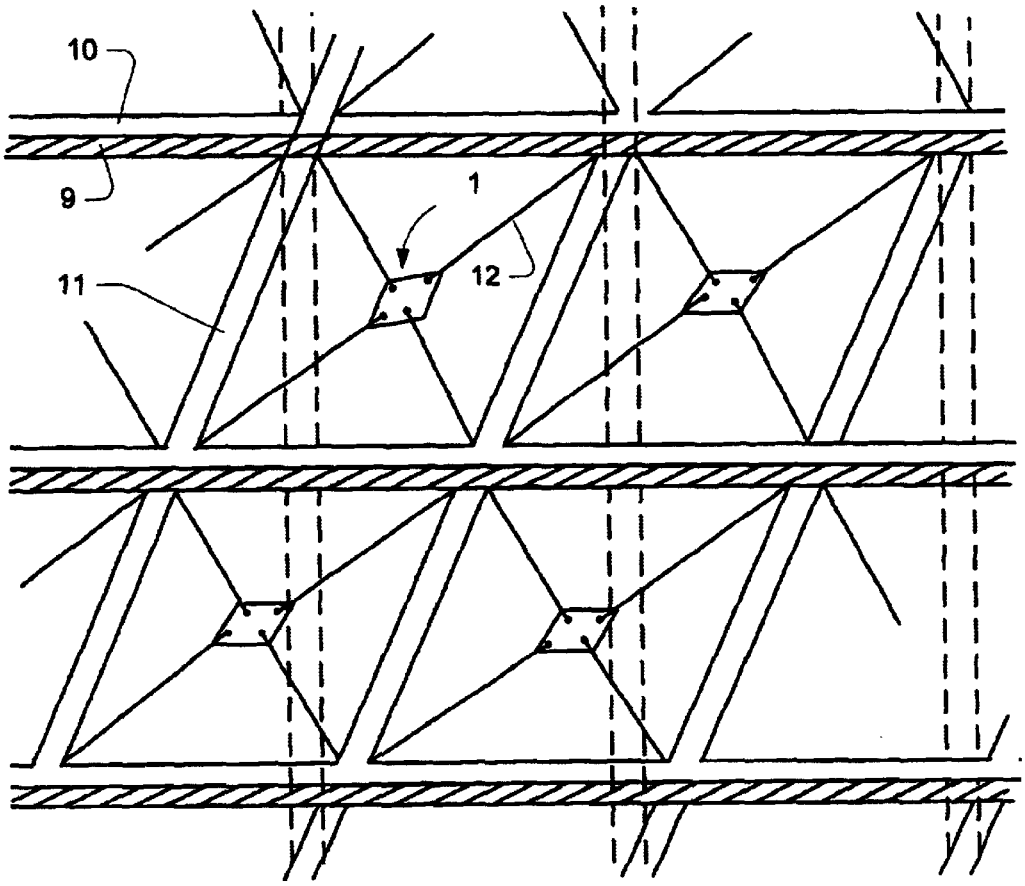
FIG. 9 is a diagrammatic representation of the structure of FIG. 3 after deformation.

The first and second embodiments to be described hereafter relating to FIGS. 3 to 9 are intended to be installed in portico civil engineering structures, that is structures including approximately horizontal girders 10 and approximately vertical poles 11 forming approximately rectangular elementary meshes inside an approximately vertical plane. FIGS. 3, 6 and 9 show these structures in which the girder 10 support the floors 9. The dots on FIG. 9 represent the position of the girders 10 and poles 11 in a normal situation and the full lines the position of the girders 10 and poles 11 following an accidental stress. Under the effect of an accidental stress, the structure warps into a parallelogram. So as to limit the amplitude of this deformation, the invention seeks to control the shortening and elongation of the elementary mesh.

According to a first embodiment shown on FIGS. 3, 4 and 5, the device 1 of the invention includes a plurality of bars 2 placed approximately parallel to one another inside a given plane $P_1$ parallel to the cutting plane of FIG. 3. These bars 2 have approximately identical lengths and are situated inside the plane $P_1$ between two approximately parallel straight lines $D_1$ and $D_2$. In the rest of the description, reference shall be made to the case where the straight lines $D_1$ and $D_2$ are approximately horizontal, as shown on FIGS. 3 and 4. However, the straight lines $D_1$ and $D_2$ can also be approximately vertical, the device 1 then being identical to the one to be described, but having undergone a rotation of 90° with respect to the representations of FIGS. 3 and 4.

The extremities of each of the bars 2 which are aligned on the straight line $D_1$ are linked to a first curving template 3 and the extremities of each of the bard 2 which are aligned on the straight line $D_2$ are linked to a second curving template 3. The two templates 3, 3' are situated inside the plane $P_1$ approximately perpendicularly to the bars. Each of the two templates 3, 3' defines a cured surface 5 on both sides of each of the bars 2. The two templates preferably have identical shapes. The device 1 is linked to the portico structure by means of four metal bars 12 disposed crosswise. Each bar 12 is fixed at one of its extremities at an angle of the rectangular mesh formed by the girders 11 and the poles 10.

In the case shown on FIGS. 3 and 4 where the straight lines $D_1$ and $D_2$ are approximately horizontal, the two bars 12 fixed at the upper angles of the mesh are linked at their other extremity to the first template 3, whereas the two bars 12 fixed to the lower angles of the mesh are linked at their extremity to the second template 3'.

In the case (not shown) where the straight lines $D_1$ and $D_2$ are vertical, the bars 12 fixed at angles situated on a given vertical side of the elementary mesh are fixed to a given template.

During an accidental stress of the structure as shown on FIG. 9, the bars 12 situated on a first diagonal of the mesh shall play the role of tie rods and extend, whereas the bars 12 situated on the second diagonal shall compress. The device 1 then warps into a parallelogram, the bars 2 folding on the curved surfaces 5 defined by the templates 3, 3'. During a subsequent stress, it is possible that the deformation is made in an opposite direction, the bars which were previously elongated then being compressed and vice versa.

The device 1 may comprise support elements 13 for limiting the tilting of said device 1 at the time it gets out of shape. The device 1 preferably comprises four support elements 13 in the form of rods, flat bars or stiffeners welded onto the templates 3,3' of said device. These four elements 13 are placed parallel to the straight lines $D_1$ and $D_2$, two support elements 13 being welded onto each template 3 on both sides of said template with respect to the plane $P_1$ as shown on FIGS. 4 and 5. The support elements 13 are thus adjacent to the bars 2 which limits the tilting of the device 1 at the time it gets out of shape.

In a preferred embodiment of the invention, the bars 12 are joined to the level of their link with the ten plates 3,3' of the device 1.

In a given civil engineering structure, depending on the sought-after effect, several devices shall preferably be used.

According to a second embodiment shown on FIGS. 6, 7 and 8, the device 1 of the invention includes two single piece elements 14 having identical superimposed shapes. Each single piece element 14 includes four bars 2 disposed crosswise inside a given plane $P_1$ parallel to the cutting plane of FIG. 6, said bars being approximately parallel with regard to one another. Each element 14 also includes four curving templates 3 disposed crosswise inside the plane P1 approximately symmetrically, each of the templates 3 being positioned between two bars 2. Each template 2 defines two curved surfaces 5, 5' so that one curved surface is arranged on both sides of each of the bars.

Placed between the two elements 14 are five washers 15, four of these being situated at the extremities of the bars 2 not linked to the templates 3, the fifth washer 15 being situated at the center of the device 1. The washers 15 are kept integral with the elements 14 by screw/nut type fixing elements. This makes it possible to keep a constant spacing between the two single piece elements 14, avoid tilting of the device 1 at the time it gets out of shape, and facilitate linking of the device 1 to the elementary mesh of the portico structure.

Similarly, the device according to the first embodiment previously described may comprise two identical superimposed single piece elements instead of a single piece element with support elements 13 limiting tilting.

The device 1 according to this second embodiment is linked to the portico structure by means of eight metal bars 16. Fixed at the level of each angle of the rectangular mesh formed by the poles 11 and the girders 10 are two bars 16 via one of their extremities. Two bars 16 fixed at adjacent angles of said mesh are linked via their other extremity to two superimposed bars 2 of the device 1. This link between the bars 16 and the bars 2 can be articulated.

During an accidental stress of the structure, the bars 16 situated on a first diagonal of the mesh shall play the role of tie rods and extend, whereas the bars 16 situated on the second diagonal shall compress. Under the effect of the stresses exerted on the bars 16, the bars 2 of the device 1 shall plastically get out of shape by folding onto the corresponding curved surfaces 5 of the templates 3, said templates operating in the plastic field.

Figure 10:
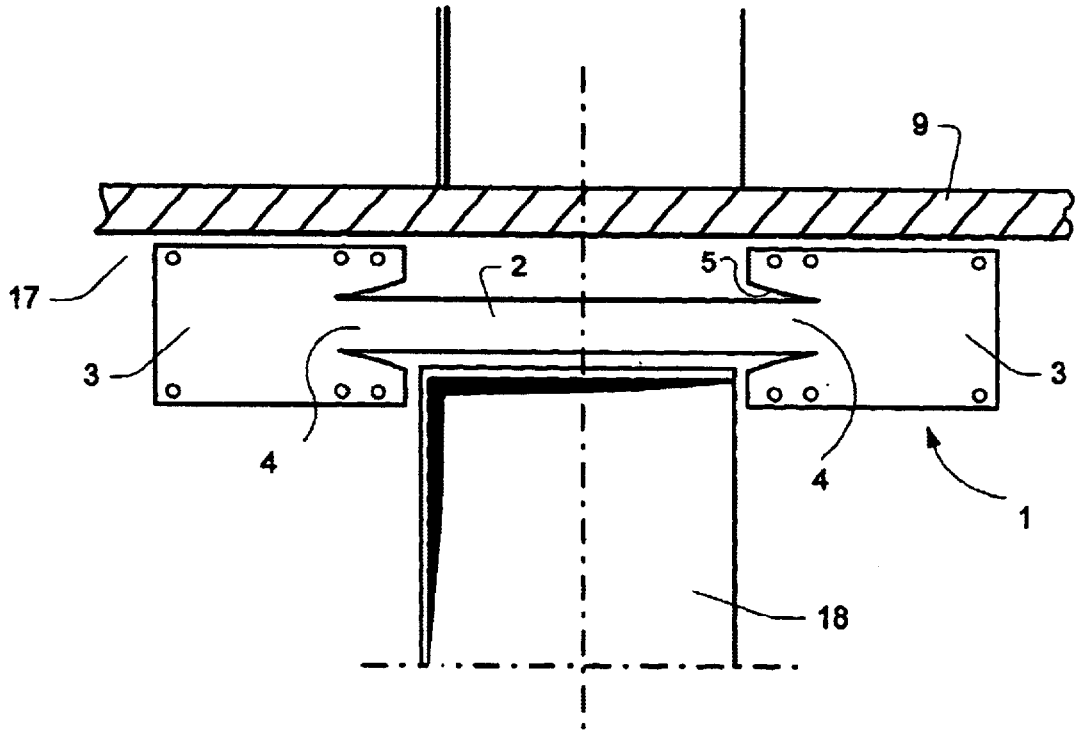
FIG. 10 is a cutaway view of a civil engineering structure comprising a device according to the invention according to a third embodiment.
Figure 11:
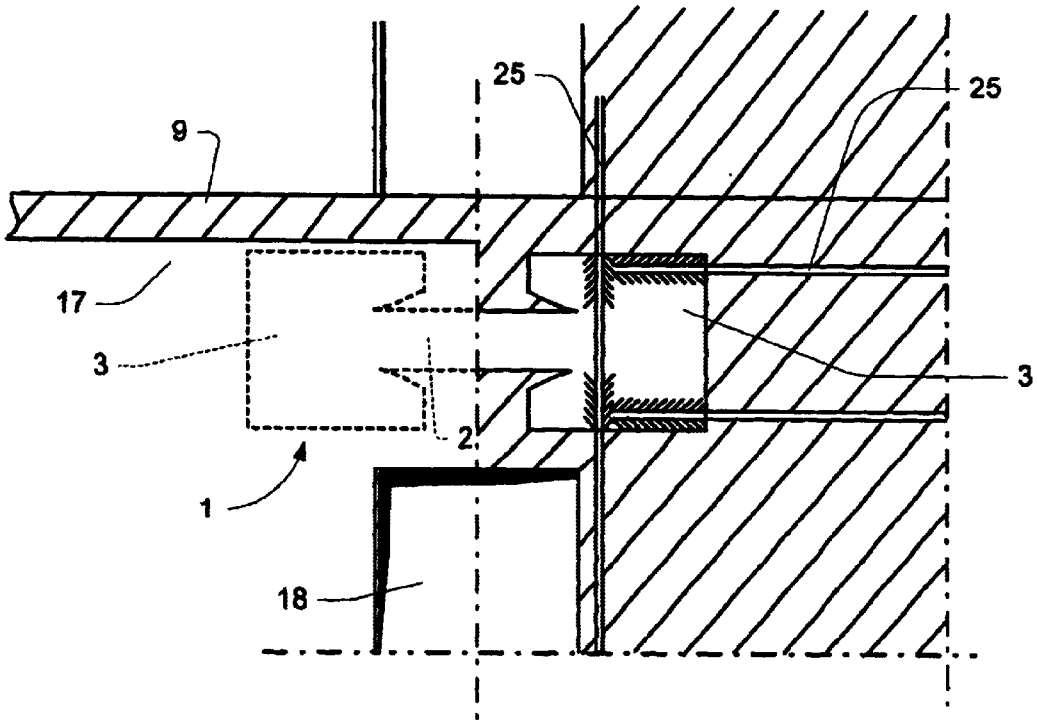
FIG. 11 is a partial cutaway view of a civil engineering structure comprising a device according to the invention according to a variant of the third embodiment.
Figure 12:
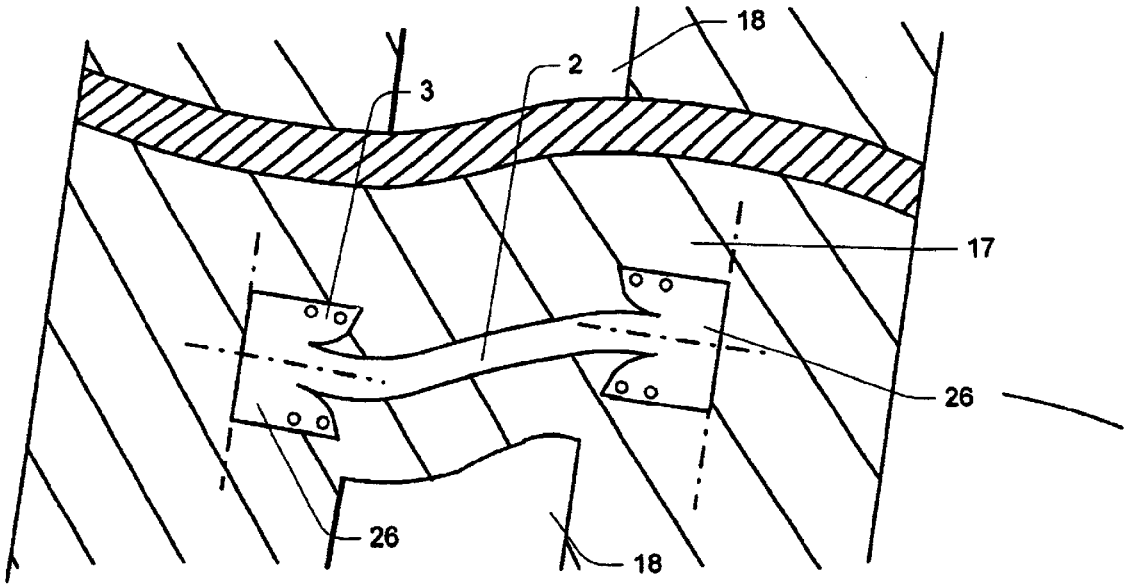
FIG. 12 is a diagrammatic cutaway representation of the structure of FIG. 10 after deformation.

There now follows a description of a third embodiment of the device of the invention with reference to FIGS. 10 to 12. In this embodiment, the device 1 includes a bar 2 linked at each of its extremities 4 to a curving template 3, each of the templates 3 defining two curved surfaces 5 placed on both sides of the bar 2. This device 1 is intended to be secured approximately horizontally to the lintels 17 of a civil engineering structure above an opening 18. The device can be bolted onto the faces of the walls of said structure as shown on FIG. 10. The device is then used for distributing or reinforcing the lintels.

In the more often case of a new construction, the device 1 can also be incorporated in the reinforced concrete comprising the walls, as shown on FIG. 11. In the latter case, the anchoring of the device 1 is ensured by welding it to the reinforcements 25 of the reinforced concrete.

FIG. 12 shows the deformation of a civil engineering structure including walls and lintels and comprising a device 1 according to the third embodiment of the invention. Owing to the accidental stress of the structure, this is translation of the walls situated on both sides of the openings 18 with respect to one another. As a result, the lintels 17 warp into the shape of an S, the same applying to the bar 2 of the device 1. However, the extreme portions 26 of the templates 3 opposite the bar 2 do not rotate with respect to the initially vertical stanchions of the openings 18 and remain orthogonal to these stanchions.

Figure 13:
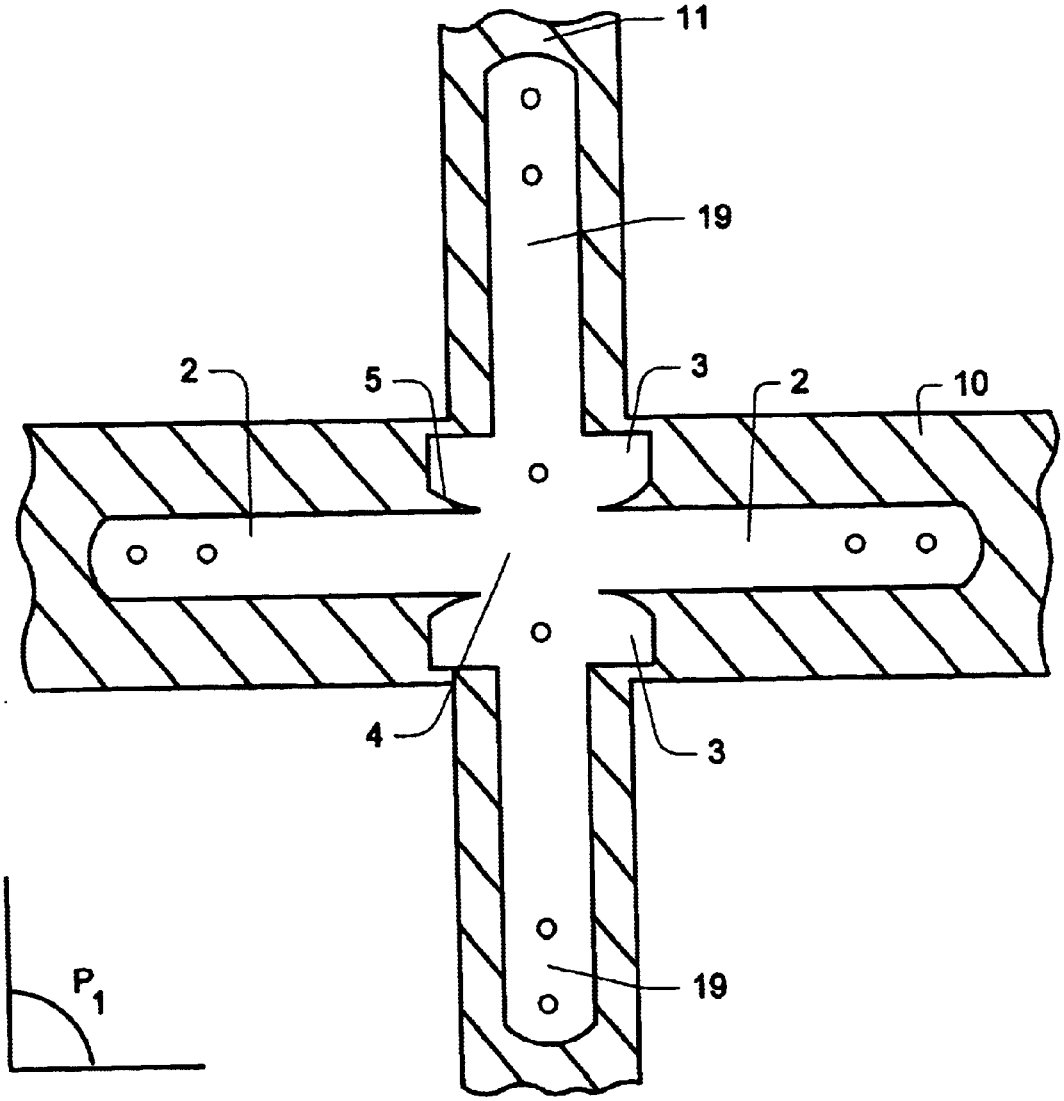
FIG. 13 is a detailed view of a civil engineering structure comprising a device according to the invention according to a fourth embodiment.

FIG. 13 represents a fourth embodiment of the device of the invention. The device 1 includes inside a given plane $P_1$: two aligned 1 bars 2 linked to each other via one of their extremities 4, two arms 9 placed perpendicular to the bars 2 at the level of the common extremity 4 of said bars 2 so as to form a cross, two curving templates 3 placed on both sides of the two bars 2 at the level of the common extremity 4 of said two bars 2, each template 3 defining a curved surface 5 for each of the two bars 2.

This device is intended to be placed in a portico structure as described previously. Said device 1 is placed at an intersection between the girders 10 and the poles 11, the bars 2 being secured approximately horizontally to the girders 10 and the arms 19 approximately vertically to the poles 11. During deformation of the structure (see FIG. 9), the elementary mesh warps into the shape of a parallelogram, which results in plasticizing the bars 2, guided by the curved surfaces 5 of the templates 3, the arms 19 working in the elastic field.

Figure 14:
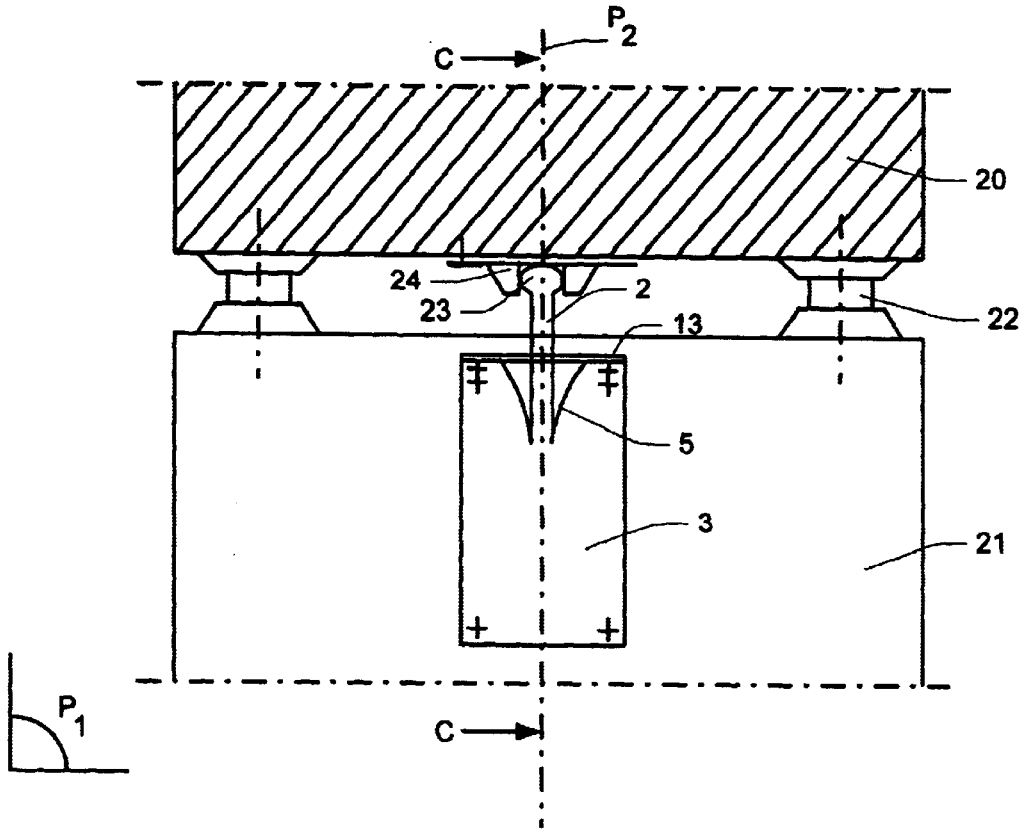
FIG. 14 is a cutaway view of a civil engineering structure comprising a device according to the invention according to a fifth embodiment.
Figure 15:
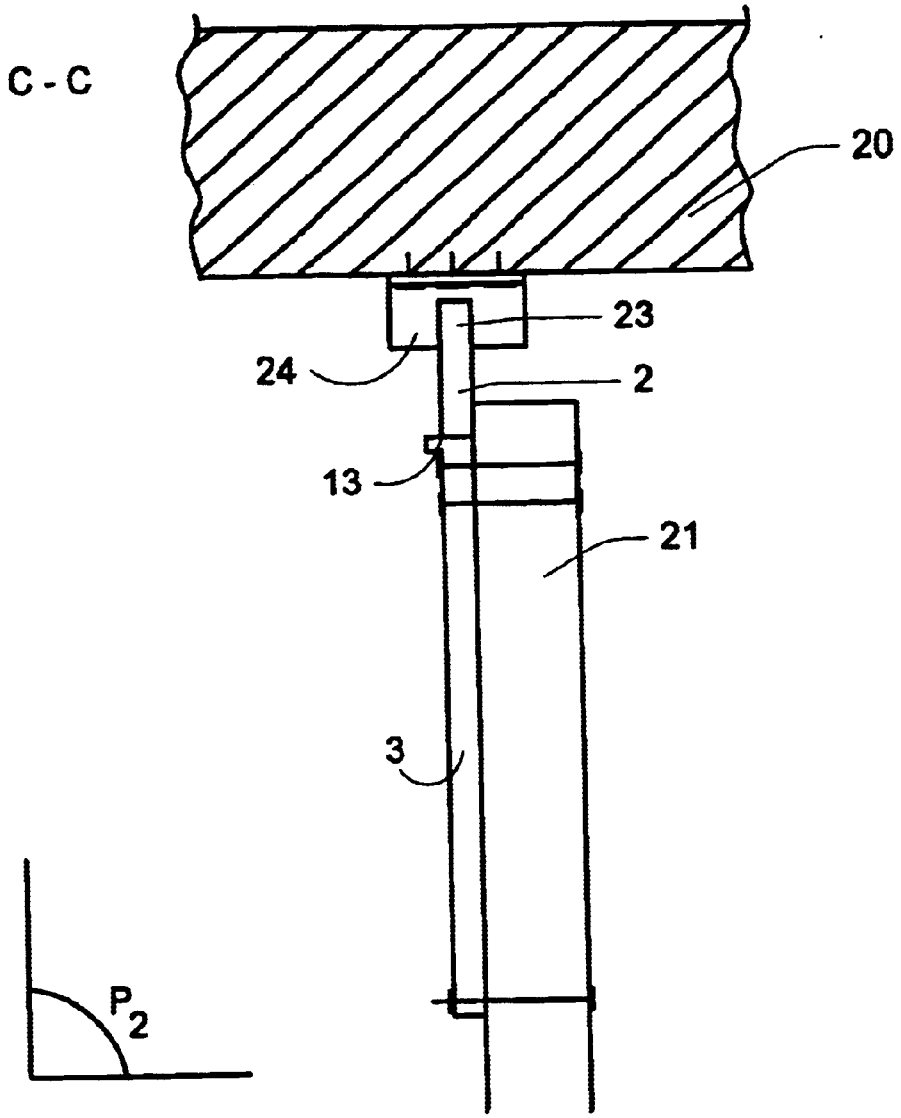
FIG. 15 is a view along the section C—C of the structure of FIG. 14.

There now follows a description of fifth embodiment of the invention with reference to FIGS. 14 and 15. This device is applicable in particular to civil engineering structures including at least two portions 20, 21, one portion 20 of said structure being placed on seismic isolators 22 with respect to the portion 21. The seismic isolators 22 can be neoprene supports, sliding supports or any other system able to isolate the structure from horizontal seismic vibrations of the ground. This device is more particularly applicable to bridges.

The device 1 includes inside a given plane $P_1$ a bar 2 linked via one of its extremities 4 to a curving template 3 defining a curved surface 5 on both sides of said bar 2. The template 3 is bolted onto one of the portions 21 of the structure. The extremity 23 of the bar 2 not linked to the template 3 is round or fitted with a joint and is able to slide into a slide 24 secured to the other portion 20 of the structure. A similar device can be positioned between the two portions 20, 21 in a plane $P_2$ orthogonal to the plane $P_1$.

Thus, where a stress is exerted on the structure, the portions 20 and 21 move in translation 17 relation to each other, the amplitude of this movement being limited by the two devices via the plastic deformation of the bars 2 guided in the templates 3. As disclosed herein, a support element 13 having the shape of a rod, flat bar or a stiffener can be positioned on the device 1 so as to limit the tilting of said device at the time it warps.

This support element 13 is placed inside a plane parallel to the plant $P_1$ and is fixed to the template 3, for instance welded to the template 3. A portion of the surface of this element 13 is adjacent to the bar so as to ensure the bar does not warp outside the plane P.

Figure 16:
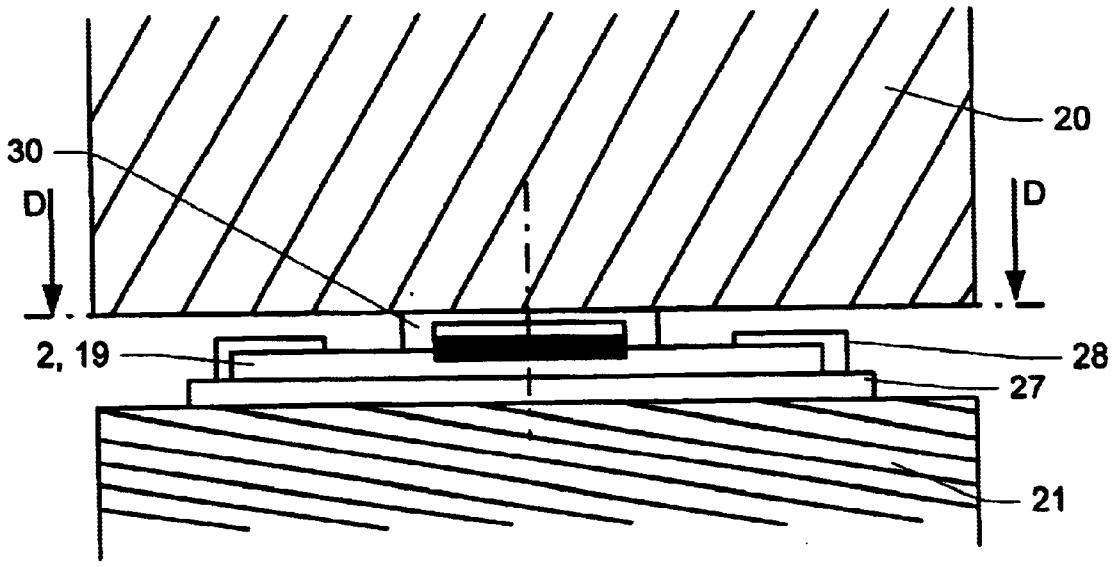
FIG. 16 is a cutaway view of a civil engineering structure comprising a device similar to the one shown on FIG. 7 or 13.
Figure 17:
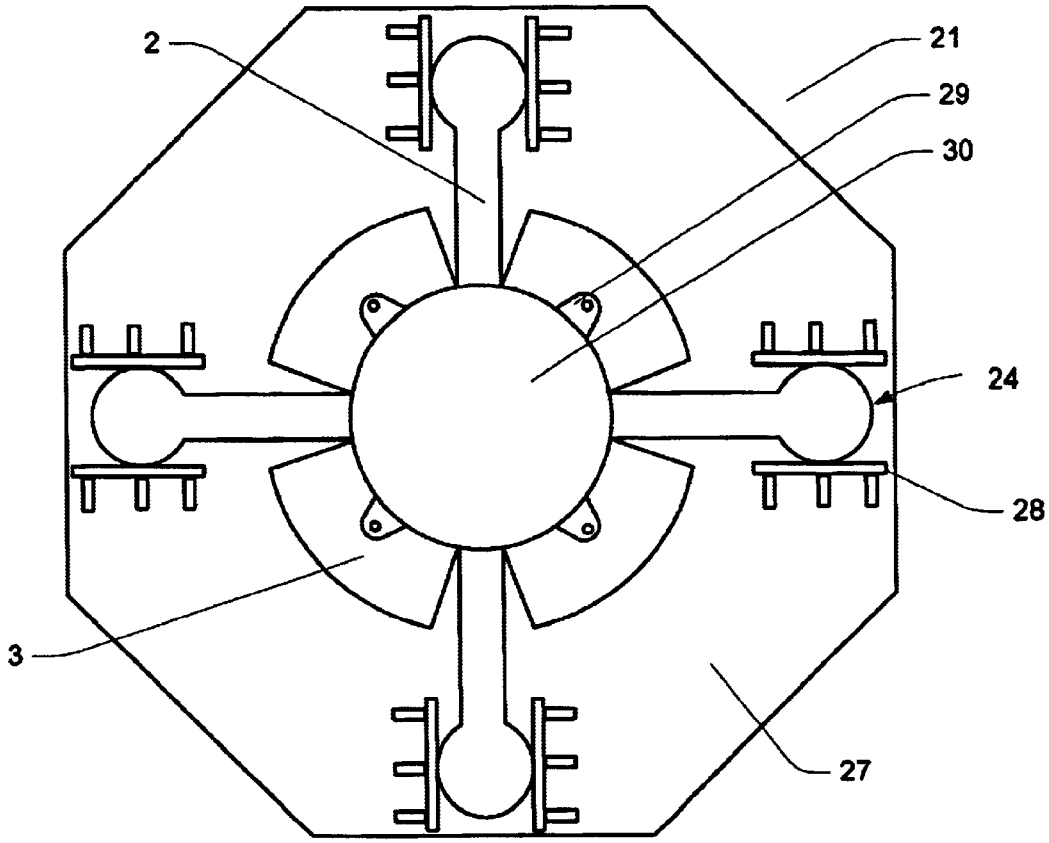
FIG. 17 is a view along the section D—D of the structure of FIG. 16.

Finally, reference is made to FIGS. 16 and 17 which represent a civil engineering structure including two portions 20, 21 able to move with respect to each other under the effect of accidental stresses. An approximately flat plate 27 is fixed, for instance bolted, onto the first portion 21. In the case of a twin-directional device, the plate 27 comprises four slides 24 each including two walls 28 projecting approximately perpendicular to the plate 27 and parallel to each other. The four slides 24 are situated at the four comers of a diamond. Secured to the second portion 20 at the right of the plate 27 is a Neoprene or pot support type support device 30. To this effect, the support device 30 may comprise fixing brackets 29 for receiving fixing means, such as bolts. The support device 30 is linked to the central portion of a device 1 similar to the one shown on FIGS. 7 or 13. The device 1 rests freely on the plate 27 fixed to the first portion 21 so that the extremities of each of the arms 19 and/or bars 2 not linked to the curving template 3 are each placed in a slide 24. Thus, under the effect of a stressing resulting in the relative movement of the two portions 20, 21 with respect to each other, the arms 19 and/or bars 2 warp by taking support on the templates 3 and thus sliding into the slides 24.

Embodiments, features and aspects of the present invention are as follows:

1. Device (1) for limiting the amplitude of the relative movement of two elements of a civil engineering structure and absorbing the deformation energy of said structure when the latter is subjected to an accidental stress, said device (1) including:
   - at least one portion able to undergo a plastic warping during the relative movement of the two elements of said structure,
   - means for guiding the plastic deformation of the portion able to undergo a plastic deformation,
   - said device (1) being characterized in that said portion able to undergo a plastic deformation and said guiding means form a single piece element.
2. Device according to claim 1, characterized in that the portion able to undergo a plastic deformation includes at least one bar (2) linked to the means for guiding plastic deformation at the level of one of its extremities (4), and in that the plastic deformation guiding means include at least one curving template (3) defining at lest one curved surface (5) on which the portion undergoing a plastic deformation folds during said deformation.
3. Device according to claim 2, characterized in that at the level of the contact line (6) between the template (3) and the extremity (4) of the bar (2) linked to the guiding means, the curved surface (5) is tangent to said bar (2), the curved surface (5) diverging with respect to the bar (2) when seen from the contact line (6), the convexity of the curved surface (5) being directed towards the bar (2).
4. Device according to claim 2 or 3, characterized in that the bar (2) has a rectangular cross section and in that at any point of the curved surface (5) defined by the curving template (3), the radius of curvature of said curved surface (5) is proportional to the width of the bar (2) measured at the level of a point of said bar (2) intended to come into contact with said point of the curved surface (5) at the time of plastic deformation.
5. Device according to one of claims 1 to 4, characterized in that the plastic deformation guiding means define at least two curved surfaces (5,5') placed on both sides of the bar (2) and symmetrical with respect to a median plane (P2) of said bar (2).
6. Device according to one of claims 1 to 5, characterized in that it is formed in a material selected from the group including steels, metal alloys and metal die composites.

7. Device according to one of claims 1 to 6, characterized in that it is formed by the cutting of a metal plate.
8. Device according to one of claims 1 to 7, characterized in that it includes several identical superimposed single piece elements (14).
9. Device according to one of claims 2 to 8, characterized in that it includes at least one support element (13) fixed to at least one template and having one portion of its surface adjacent to at least one bar (2), said support element (13) being used to limit the tilting of the device (1) when the latter is warped.
10. Device according to one claims 2 to 9, characterized in that it includes a bar (2) linked at each of its extremities (4) to a curving template (3), each of the templates (3) defining two curved surfaces (5) placed on both sides of the bar (2).
11. Device according to one of claims 2 to 9, characterized in that it includes a plurality of bars (2) placed approximately parallel to one another inside a given plan (P1) between two approximately parallel straight lines (D1, D2), the extremities of each of the bars (2), which are aligned on a first straight line (D1), being linked to a first curving template (3) and the extremities of the bars (2), which are aligned on the second straight line (D2), being linked to a second curving template (3'), the two templates (3, 3') being situated inside said plane (P1) approximately perpendicular to said bars (2) and each defining a curved surface (5) on both sides of each of the bars (2).
12. Device according to one of claims 2 to 9, characterized in that it includes:
   four bars (2) disposed crosswise inside a given plane (P1) and approximately perpendicular to one another,
   four curving templates (3) disposed crosswise in said plant (P1) approximately symmetrically, each of the templates (3) being positioned between two bars (2), said templates (3) each defining two curved surfaces (5,5'), so that one curved surface (5) is placed on both sides of each of the bars (2).
13. Device according to one of claims 2 to 9, characterized in that it includes in a given plane (P1):
   two aligned bars (2) linked to each other by one of their extremities (4),
   two arms (19) placed perpendicular to the bars (2) at the level of the common extremity (4) of said bars (2) so as to form a cross,
   two curving templates (3) placed on both sides of the two bars (2) at the level of the common extremity (4) of said two bars (2), each template (3) defining one curved surface (5) for each of the two bars (2).
14. Device according to one of claims 2 to 9, characterized in that the extremity (23) of the bar (4) not linked to the guiding means is round or is fitted with a joint.
15. Civil engineering structure including lintels (17) and comprising a device (1) according to claim 10, characterized in that said device (1) is positioned and fixed approximately horizontally on the lintels (17).
16. Civil engineering portico structure including approximately horizontal girders (10) and approximately vertical poles (11) forming approximately rectangular elementary meshes, said structure including at least one device (1) according to claim 11, characterized in that the structure comprises four bars (12) disposed crosswise, each bar (12) being fixed at one of its extremities to an angle of said mesh, two adjacent bars (12) being fixed at the other of their extremities to a first template (3) of said device (1), the other two bars (12) being fixed at the other of their extremities to the second template (3') of said device (1).
17. Civil engineering portico structure including approximately horizontal girders (10) and approximately vertical poles (11) forming approximately rectangular elementary meshes, said structure including at least one device (1) according to claim 12, characterized in that it comprises eight bars (16) placed so that:
   at the level of each angle of said mesh two bars (16) are fixed by one of their extremities,
   two bars (16) fixed at two adjacent angles are linked via their other extremity to a given bar (2) of said device (1).
18. Civil engineering portico structure including approximately horizontal girders (10) and approximately vertical poles (11) forming approximately rectangular elementary meshes, said structure including at least one device (1) according toe claim 13, characterized in that the device (1) is positioned at the level of the intersection between the girders (10) and poles (11, the bars (2) of the device (1) being fixed approximately horizontally on the girders (10) and the arms (19) approximately vertically on the poles (11).
19. Civil engineering structure including at least two portions (20, 21) between which seismic isolators (22) are placed and including at least one device (1) according to claim 14, characterized in that the guiding means are secured to a first portion (21) of said structure and in that the extremity (23) of the bar (2) not linked to said guiding means is able to slide in a slide (24) secured to a second portion (20) of said structure.
20. Civil engineering structure including at least two portions (20, 21) and at least one device (1) according to claim 12 or 13, characterized in that the central portion of the device (1) situated towards the common extremity of the bars (2) is linked to a support device (30) fixed to one portion (20) of said structure in that the extremity of each of the arms (19) and/or bars (2) not linked to the guiding means is able to slide in a slide (24) secured to another portion (21) of said structure.

The invention, therefore, is well adapted to carry out the objects and attain the ends and advantages mentioned, as well as others inherent therein. While the invention has been depicted, described, and is defined by reference to exemplary embodiments of the invention, such references do not imply a limitation on the invention, and no such limitation is to be inferred. The invention is capable of considerable modification, alternation, and equivalents in form and function, as will occur to those ordinarily skilled in the pertinent arts and having the benefit of this disclosure. The depicted and described embodiments of the invention are exemplary only, and are not exhaustive of the scope of the invention. Consequently, the invention is intended to be limited only by the spirit and scope of the appended claims, giving full cognizance to equivalents in all respects.

What is claimed is:

1. An apparatus for limiting the amplitude of the relative movement of two elements of a civil engineering structure and absorbing the deformation energy of said structure when the latter is subjected to an accidental stress, said apparatus comprising:
   at least one portion able to undergo a plastic deformation during a relative movement of two elements of a civil engineering structure; and
   means for guiding the plastic deformation of said at least one portion, wherein said at least one portion and said guiding means form a single unitary piece element.

2. The apparatus according to claim 1, wherein said at least one portion comprises at least one bar having extremities, the bar extends from said means for guiding plastic deformation at the level of one of said extremities, and wherein the plastic deformation guiding means includes at least one curving template defining at least one curved surface on which the portion undergoing a plastic deformation folds during said deformation.

3. The apparatus according to claim 2, wherein at the level of a contact line between the template and the extremity of the bar extending from said guiding means, the curved surface is tangent to said bar, the curved surface diverging with respect to the bar when seen from the contact line, the convexity of the curved surface being directed towards the bar.

4. The apparatus according to claim 2, wherein the bar has a rectangular cross section and at any point of the curved surface defined by the curving template, the radius of curvature of said curved surface is proportional to the width of the bar measured at the level of a point of said bar in such a way that said point of said bar can come into contact with said point of the curved surface at the time of plastic deformation.

5. The apparatus according to claim 2, wherein the plastic deformation guiding means defines at least two curved surfaces placed on both sides of the bar and symmetrical with respect to a median plane of said bar.

6. The apparatus according to claim 1, wherein material for said at least one portion and said means for guiding the plastic deformation is selected from the group consisting of steels, metal alloys and metal die composites.

7. The apparatus according to claim 1, wherein said at least one portion and said means for guiding the plastic deformation are formed by cutting a metal plate.

8. The apparatus according to claim 1, wherein said at least one portion and said means for guiding the plastic deformation include several identical superimposed single piece elements.

9. The apparatus according to claim 2, wherein said at least one portion and said means for guiding the plastic deformation further comprises at least one support element fixed to at least one template and having one portion of its surface adjacent to at least one bar, said at least one support element being used to limit deformation.

10. The apparatus according to claim 2, wherein said means for guiding the plastic deformation comprises a first and second portion each comprising a curving template and wherein said bar couples said portions, each of the templates defining two curved surfaces placed on both sides of the bar.

11. The apparatus according to claim 2, wherein said at least one portion and said means for guiding the plastic deformation further comprises a plurality of bars placed approximately parallel to one another inside a given plan between two approximately parallel straight lines, the extremities of each of the bars, which are aligned on a first straight line, extend from a first curving template and the extremities of the bars, which are aligned on the second straight line, extend from a second curving template, the two templates being situated inside said plane approximately perpendicular to said bars and each defining a curved surface on both sides of each of the bars.

12. The apparatus according to claim 2, wherein said at least one portion and said means for guiding the plastic deformation further comprises four bars disposed crosswise inside a given plane and approximately perpendicular to one another, four curving templates disposed crosswise in said plant approximately symmetrically, each of the templates being positioned between two bars, said templates each defining two curved surfaces, so that one curved surface is placed on both sides of each of the bars.

13. The apparatus according to claim 2, wherein said at least one portion and said means for guiding the plastic deformation further comprises in a given plane:

two aligned bars extending in opposite directions from said means for guiding;

two arms placed perpendicular to the bars extending from the means for guiding so as to form a cross; and two curving templates placed on both sides of the two bars at the level from which said two bars extend, each template defining one curved surface for each of the two bars.

14. The apparatus according to claim 2, wherein the extremity of the bar not extending from the guiding means is round or is fitted with a joint.

15. The apparatus according to claim 10, further comprising a civil engineering structure including lintels, wherein said at least one portion and said means for guiding the plastic deformation are positioned and fixed approximately horizontally on the lintels.

16. Civil engineering structure including an apparatus for limiting the amplitude of the relative movement of two elements of a civil engineering structure and absorbing the deformation energy of said structure when the latter is subjected to an accidental stress, said apparatus comprising:

at least one portion able to undergo a plastic deformation during a relative movement of two elements of a civil engineering structure; and means for guiding the plastic deformation of said at least one portion, wherein said at least one portion and said guiding means form a single piece element integrally made in one piece, and said at least one portion comprises at least one bar having extremities, the bar extends from said means for guiding plastic deformation at the level of one of said extremities, and the plastic deformation guiding means includes at least one curving template defining at least one curved surface on which the portion undergoing a plastic deformation folds during said deformation.

17. Civil engineering structure as in claim 16, further comprising lintels and a bar extending from each of said extremities to a curving template, each of the templates defining two curved surfaces placed on both sides of the bar, wherein said apparatus is positioned and fixed approximately horizontally on said lintels.

18. Civil engineering structure as in claim 16, wherein said at least one portion and said means for guiding the plastic deformation further comprises a plurality of bars placed approximately parallel to one another inside a given plan between two approximately parallel straight lines, the extremities of each of the bars, which are aligned on a first straight line, extending from a first curving template and the extremities of the bars, which are aligned on the second straight line, extends from a second curving template, the two templates being situated inside said plane approximately perpendicular to said bars and each defining a curved surface on both sides of each of the bars, and wherein said structure is a portico structure including approximately horizontal girders and approximately vertical poles forming approximately rectangular elementary meshes, wherein the structure comprises four bars disposed crosswise, each bar being fixed at one of its extremities to an angle of said mesh, two adjacent bars being fixed at the other of their extremities to a first template of said arrangement, the other two bars being fixed at the other of their extremities to the second template of said arrangement.

19. Civil engineering structure as in claim 16, wherein said structure is a portico structure comprising approximately horizontal girders and approximately vertical poles forming approximately rectangular elementary meshes, and wherein said at least one portion and said means for guiding the plastic deformation further comprises four bars disposed crosswise inside a given plane and approximately perpendicular to one another, four curving templates disposed crosswise in said plant approximately symmetrically, each of the templates being positioned between two bars, said templates each defining two curved surfaces, so that one curved surface is placed on both sides of each of the bars, said arrangement further comprises eight bars placed so that:

at the level of each angle of said mesh two bars are fixed by one of their extremities, two bars fixed at two adjacent angles coupled via their other extremity to a given bar of said arrangement.

20. Civil engineering structure according to claim 16, wherein said structure is a portico structure comprising approximately horizontal girders and approximately vertical poles forming approximately rectangular elementary meshes, wherein said at least one portion and said means for guiding the plastic deformation further comprises in a given plane:

two aligned bars extending in opposite directions from said means for guiding;

two arms placed perpendicular to the bars extending from the means for guiding so as to form a cross; and two curving templates placed, on both sides of the two bars at the level from which said two bars extend, each template defining one curved surface for each of the two bars, and wherein said arrangement is positioned at the level of the intersection between the girders and poles, the bars of the arrangement being fixed approximately horizontally on the girders and the arms approximately vertically on the poles.

21. Civil engineering structure as in claim 16, further comprising at least two portions between which seismic isolators are placed and wherein the extremity of the bar not extending from the guiding means is round or is fitted with a joint and the guiding means are secured to a first portion of said structure and in that the extremity of the bar not extending from said guiding means is able to slide in a slide secured to a second portion of said structure.

22. Civil engineering structure as in claim 20, further comprising at least two portions, wherein the central portion of the arrangement situated towards the common extremity of the bars is coupled with a support device fixed to one portion of said structure in that the extremity of each of the arms and/or bars not extending from the guiding means is able to slide in a slide secured to another portion of said structure.

* * * * *